US009826881B2

(12) United States Patent
Cantrell et al.

(10) Patent No.: US 9,826,881 B2
(45) Date of Patent: Nov. 28, 2017

(54) SILVERWARE, FLATWARE OR PARTS WASHER APPARATUS AND METHOD THEREOF

(71) Applicant: UNIFIED BRANDS, INC., Jackson, MS (US)

(72) Inventors: John W. Cantrell, San Antonio, TX (US); Mark Churchill, Grain Valley, MO (US); Michael Licata, Lee's Summit, MO (US); David Gast, Lenexa, KS (US)

(73) Assignee: Unified Brands, Inc., Jackson, MS (US)

( * ) Notice: Subject to any disclaimer, the term of this patent is extended or adjusted under 35 U.S.C. 154(b) by 108 days.

(21) Appl. No.: 14/538,618

(22) Filed: Nov. 11, 2014

(65) Prior Publication Data

US 2015/0068564 A1 Mar. 12, 2015

Related U.S. Application Data

(62) Division of application No. 12/697,534, filed on Feb. 1, 2010, now Pat. No. 8,882,929.

(Continued)

(51) Int. Cl.

*B08B 3/00* (2006.01)
*A47L 15/08* (2006.01)

(Continued)

(52) U.S. Cl.

CPC ..... *A47L 15/08* (2013.01); *A47L 15/0089* (2013.01); *A47L 15/4217* (2013.01); *A47L 15/4225* (2013.01); *B08B 3/104* (2013.01)

(58) Field of Classification Search

None

See application file for complete search history.

(56) References Cited

U.S. PATENT DOCUMENTS 2,264,713 A 11/1938 Reifenberg
4,773,436 A 9/1988 Cantrell et al.

(Continued)

FOREIGN PATENT DOCUMENTS

DE 3604938 8/1987
JP 6463086 A 3/1989

OTHER PUBLICATIONS

International Search Report for PCT/US2010/022763, dated Mar. 17, 2010.

(Continued)

*Primary Examiner* — Eric W Golightly

(74) *Attorney, Agent, or Firm* — Kutak Rock LLP; Bryan P. Stanley

(57) ABSTRACT

An apparatus and a method of washing (or pre-washing) silverware/flatware, or one or more other objects/parts is provided. The apparatus and method utilizes a fluid-push/pull pumping system and method in which generally an entire volume of fluid is pushed or pulled through a cavity of a housing in which the silverware/flatware or other objects/parts are located. The housing is configured to hold a mass of silverware or other item(s) within the cavity. The pumping system is configured to pump generally an entire volume of fluid is out of the cavity, and to direct the pumped fluid back into the cavity to create a generally continuous flow of generally an entire volume of fluid through the cavity, thereby causing the fluid to flow through the mass of silverware or other item(s).

8 Claims, 7 Drawing Sheets

Related U.S. Application Data

(60) Provisional application No. 61/148,795, filed on Jan. 30, 2009.

(51) Int. Cl.

| | |
|---|---|
| ***A47L 15/00*** | (2006.01) |
| ***B08B 3/10*** | (2006.01) |
| ***A47L 15/42*** | (2006.01) |

(56) References Cited

U.S. PATENT DOCUMENTS

| | | | |
|---|---|---|---|
| 5,927,309 | A | 7/1999 | Hoover et al. |
| 5,934,486 | A | 8/1999 | Jarvis et al. |
| 6,976,496 | B2 | 12/2005 | Cantrell et al. |
| 7,246,624 | B2 | 7/2007 | Cantrell |
| 2004/0244822 | A1 | 12/2004 | Cantrell et al. |
| 2006/0254619 | A1 | 11/2006 | Bigott |
| 2007/0151584 | A1 | 7/2007 | Omachi |
| 2008/0099055 | A1 | 5/2008 | Lemley |

OTHER PUBLICATIONS

Written Opinion of the International Search Authority for PCT/US2010/022763, dated Mar. 17, 2010.

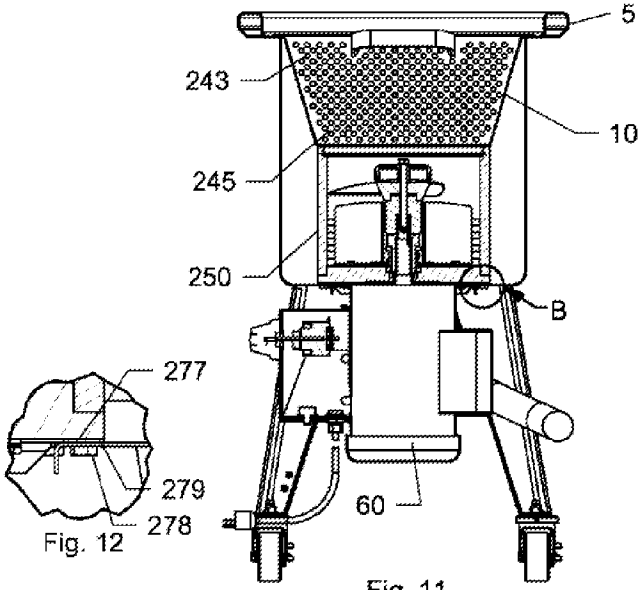
Fig. 11
Fig. 12
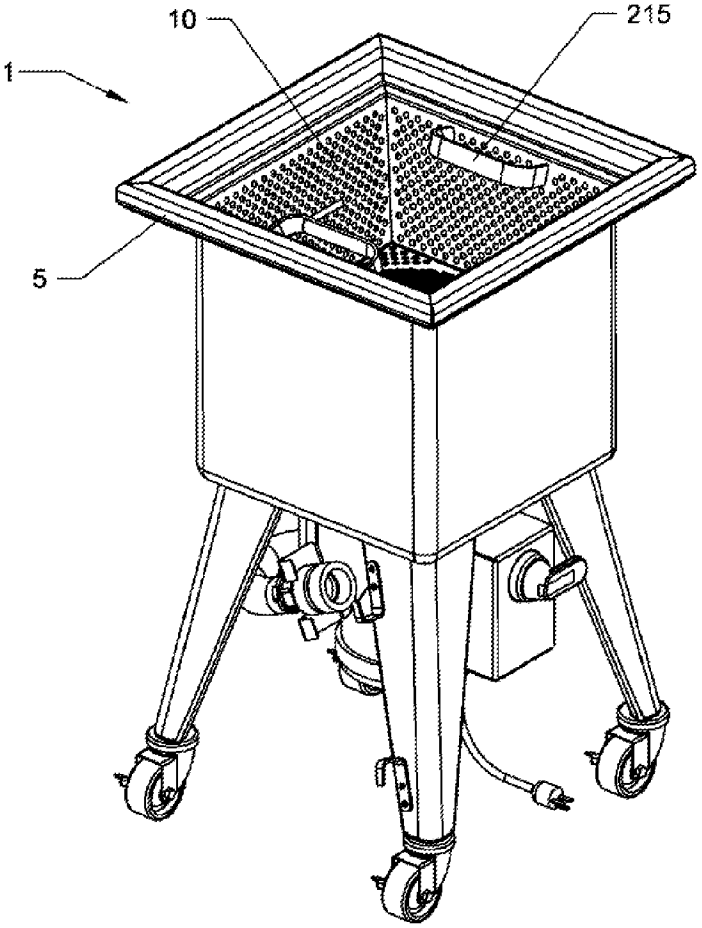
Fig. 9

SILVERWARE, FLATWARE OR PARTS WASHER APPARATUS AND METHOD THEREOF

CROSS-REFERENCE TO RELATED APPLICATIONS

This application is a divisional of U.S. patent application Ser. No. 12/697,534, filed Feb. 1, 2010 (now U.S. Pat. No. 8,882,929), which claims priority pursuant to 35 U.S.C. 119(e) to U.S. Provisional Patent Application Ser. No. 61/148,795, filed Jan. 30, 2009, the entire disclosures of which are incorporated herein by reference.

FIELD OF THE INVENTION

The present general inventive concept relates to a washing (or pre-washing) system, and more particularly, to an apparatus and a method of washing (or pre-washing) silverware/flatware, or one or more other objects/parts, utilizing a fluid-push/pull system.

BACKGROUND OF THE INVENTION

Pot and pan washing machines, of the type used in restaurants, institutions and other eating facilities often involve a large wash tank or basin in which water (mixed with detergent, generally a cleaning "fluid") is circulated within a wash tank to wash the "wares" (i.e. pots, pans, utensils, flatware/silverware, etc.) to provide a washing action. One such machine is described in U.S. Pat. No. 4,773,436 issued to Cantrell et al. (the "436 Patent"), the entire disclosure of which is incorporated herein by reference. The machine of the '436 Patent includes a wash tank with multiple jets evenly spaced apart at an elevated position along the rear wall of the wash tank. The tank is filled with water/detergent (fluid) to a level above the position of the jets. Pots and pans and other wares are placed in the wash tank, and a pump is activated to draw fluid from within the wash tank and direct it through the jets to create a jet stream. Each jet directs its jet stream toward the bottom wall of the wash tank, the bottom wall then deflects the jet stream upward and towards the front wall of the tank. The front wall then deflects the upward moving jet stream towards the rear wall of the tank, and the rear wall deflects the jet stream downward and back towards the front wall along the bottom wall. The combination of deflections of the jet stream from the bottom, front and rear walls provides a rolling washing action within the wash tank that results in effective cleaning of all surfaces of the wares being washed.

Although the prior art pot and pan washing machine disclosed in the '436 Patent provides an exceptional wash action for washing wares such as utensils (i.e. ladles, tongs, spatulas, etc.) and pots and pans, it is less desirable for washing smaller, generally heavy (relative to its size/footprint) wares and/or wares that are prone to tight stacking or nesting on top of each other such as flatware/silverware. Thus, rather than being washed using a washing machine having a wash tank filled with water/detergent, wares such as flatware/silverware is typically spray washed by placing mesh (or porous) racks of flatware/silverware in a machine (typically referred to as a "commercial dishwasher") that sprays water/detergent over the racks of flatware/silverware from one or more jets typically located on rotating wash arms. The streams of water/detergent from such jets are ultimately deflected from their original paths by the flatware or even by the racks in which the flatware is located. Even in machines that utilize numerous jets from multiple angles, the deflections and/or nesting of like types of wares (i.e. multiple spoons stacked on top of each other) typically result in preventing portions of some pieces of flatware/silverware from becoming fully cleaned. Thus, in many restaurants/institutions, staff members will run the racks of flatware/silverware through the spray washing machine multiple times, and in some cases may even hand polish flatware/silverware that is not fully cleaned. Moreover, because most spray washing machines operate at very high temperatures to disinfect the wares, soil that is not removed during a wash cycle will tend to bake onto the ware as the ware leaves the wash section of the washing machine and enters the 180 degree F. sanitizing rinse. This makes the soil even more difficult to remove even through additional cleaning or polishing. To assist in preventing such soil bake-on problems, it is common to pre-soak flatware/silverware in a tub of soapy water prior to running the wares through a spray washing machine. Nevertheless, even pre-soaking flatware/silverware leaves soil that still cannot be removed through spray washing due to the fact that there is no mechanical wash action to aid in soil removal and further due to nesting and lack of movement of the wares which prevents the soap from coming in contact with nested surfaces of the wares.

In an attempt to take advantage of the wash action created by a wash tank type machine such as that disclosed in the '436 Patent, the invention disclosed in U.S. Pat. No. 6,976,496 (the "496 Patent"), the entire disclosure of which is incorporated herein by reference, provides a powered utensil basket that captures a jet stream from the washing machine in which the basket is located to maintain the washing action of the machine within the basket. Although the powered utensil basket of the '496 Patent does provide a segregated washing area for utensils and other items that is removable from the washing machine, the basket itself is rather bulky, and furthermore is sometimes not utilized in operation. As an alternative to the basket, U.S. application Ser. No. 11/775,465 (the "465 Application"), now U.S. Pat. No. 7,523,757, the entire disclosure of which is incorporated herein by reference, discloses a divider that is repositionable within a wash tank of a washing machine via a series of channels along the walls of the wash tank to provide a segregated washing area within the wash tank in which the washing action of the machine is maintained. Notwithstanding, the wash tank is often of considerable depth making it difficult to retrieve smaller items that have been loosely sprawled across the bottom of the tank. In either of the above cases, if large masses of wares such as flatware/silverware are piled into the wash tank or basket, the jet stream will tend to rush over or become diverted/deflected by the top surface of the mass of wares rather than continuing through the entire mass and around all surfaces of each individual ware. Thus, the un-exposed surfaces of the wares will never be exposed to the jet stream, and therefore are not influenced by the washing action of the machine.

While the basket of the '496 Patent and the divider of the '465 Application do at least partially utilize the washing action of the jet stream, and there is some benefit in the ware being fully submerged (i.e. soaking), the jet stream(s) still suffers from deflections that decrease the efficiency of the machine, particularly when multiple pieces of silverware/flatware are stacked close together or on top of one another. Thus, as both wash tank type and spray type washing machines suffer from similar deficiencies in cleaning parts such as silverware/flatware, it is desirable to provide an apparatus and method for washing silverware/flatware that provides increased cleansing efficiency/effectiveness over machines and mechanical/non-mechanical washing methods of the prior art.

SUMMARY OF THE INVENTION

A principal object of the present general inventive concept is to provide a washing system for washing silverware/flatware and other small, irregularly shaped and/or elongated objects/parts (either individually or as a group of objects/parts) that effectively and thoroughly removes debris therefrom.

Another object of the present general inventive concept is to provide a washing system that supports silverware/flatware or other objects/parts in an orientation that is conducive to removing debris therefrom and/or sorting the silverware/flatware or other objects/parts as part of the process.

Another object of the present general inventive concept is to provide a washing system that has one or more racks to support silverware/flatware or other objects/parts.

Another object of the present general inventive concept is to provide a washing system that exposes generally all surfaces of generally all silverware/flatware or other objects/parts to debris removal fluid streams to effectively remove debris therefrom.

Another object of the present general inventive concept is to provide a washing system that utilizes a fluid-push/pull (draft or induction system) to forcibly push/pull, channel or funnel fluid through submerged silverware/flatware or one or more other objects/parts thereby substantially neutralizing unwanted fluid deflection that occurs in prior art systems. Still another object of the present general inventive concept is to provide a fluid-push/pull, draft or induction system to forcibly push/pull, channel or funnel fluid through submerged silverware/flatware or one or more other objects/parts in such a way that the fluid has no alternative path but to travel through generally the entire mass of silverware/flatware or one or more other objects/parts.

Another object of the present general inventive concept is to provide a washing system that washes silverware/flatware or one or more other objects/parts in such a manner that eliminates or substantially reduces any post-wash treatment, e.g., additional handling or polishing.

Another object of the present general inventive concept is to provide a washing system that is a stand-alone unit.

Another object of the present general inventive concept is to provide a washing system that is compact.

Another object of the present general inventive concept is to provide a standalone washing system that occupies a generally small footprint.

Another object of the present general inventive concept is to provide a washing system that drops into a counter-top and/or that is built into a counter-top.

Another object of the present general inventive concept is to provide a washing system that is energy efficient.

Another object of the present general inventive concept is to provide an efficient method of washing silverware/flatware or one or more other objects/parts that conserves washing fluid, uses water more effectively, and consumes minimal operator time.

The above objects of the instant invention are accomplished through the use of a washing system that includes a manifolding to direct a flow of fluid (such as water/detergent) through a silverware/flatware (or one or more other objects/parts) containing cavity (or cavities). A pumping system (including a propeller, impellor or other suitable pumping method, as well as appropriate manifolding) moves the fluid through the pumping system (including appropriate manifolding) to create a substantial flow of fluid through generally the entire cavity (cavities). Fluid is forced through the cavity (cavities) and thus through the mass of flatware/silverware (or one or more other objects/parts) positioned within the cavity (cavities). In the preferred embodiment, the fluid essentially is provided no alternative path of travel to circulate through the washing system other than directly through generally the entire mass of flatware/silverware (or one or more other objects/parts) located within the cavity (cavities). As a result, the flow of fluid more fully and closely surrounds and travels around the entire surface of each piece of flatware/silverware (or one or more other objects/parts) within the cavity (cavities) which substantially neutralizes the unwanted fluid deflection that occurs in prior art systems.

In some preferred embodiments, the pumping system generally pushes fluid through said cavity (cavities). In such embodiments, one or more openings of the cavity (cavities) are located at the discharge location of the pumping system, and the fluid flow from the discharge of the pumping system is forced through the cavity (cavities) and thus through the object(s) contained therein. The fluid is returned to the pumping system after it has been forced through the object(s) in the cavity (cavities) via one or more openings at the intake location of the pumping system. In some such embodiments, the cavity (cavities) is generally open at the intake location of the pumping system to provide little to no back pressure, except for gravity which ultimately assists in directing the flow of fluid from the cavity back into the pumping system. In other such embodiments, a closed fluid circuit is utilized.

In some preferred embodiments, the pumping system generally pulls fluid through said cavity (cavities). In such embodiments, one or more openings of the cavity (cavities) are located at the intake location of the pumping system, and the fluid flow from the intake of the pumping system pulls fluid out of the cavity (cavities) and thus through the object(s) contained therein. The fluid is returned to the pumping system after it has been forced through the object(s) in the cavity (cavities) via one or more openings at the discharge location of the pumping system. In some embodiments, the cavity (cavities) is generally open at the discharge location of the pumping system to provide little to no back pressure, except for gravity which ultimately assists in directing the flow of fluid from the pumping system back into the cavity (cavities). In alternative embodiments, a closed fluid circuit is utilized.

In some embodiments of both the fluid push and fluid pull embodiments discussed above, the flow of fluid from the pumping system discharge is allowed to change velocity and/or direction through the use of gravity prior to its return through the pumping system. In other words, the pumping system intake (draw) is not the only influence in the direction and/or velocity in which the fluid flows from the pumping system discharge through the cavity (cavities) and/or the manifolding. In alternative embodiments, the design of the structure of the cavity (cavities) and/or the manifolding significantly alters at least a portion of the flow direction and/or velocity of fluid through the cavity (cavities).

In one preferred embodiment, the pumping system is capable of operation in both forward and reverse directions, such that the pumping system may alternatively be operated in a first direction to push fluid into the opening(s) of the cavity (cavities), in a second direction to pull fluid down through the opening(s) of the cavity (cavities). In one such embodiment, a control system of the pumping system automatically oscillates the pumping system between forward and reverse directions during a wash cycle (i.e. 10 minutes forward and then 10 minutes reverse or 10 minutes forward, 10 minutes off, 10 minutes reverse, etc.). In still another embodiment, a control system of the pumping system pulses operation of the pumping system to pulsate the flow of fluid through the cavity (cavities) of the washing system of the inventive concept. For example, the pumping system may be pulsed to operate in the forward direction for 1 minute and then turned off for one minute (or forward 1 minute, off 1 minute, reverse 1 minute, etc.).

In some preferred embodiments, the manifolding is created at least in part by the housing of the washing system.

In yet other preferred embodiments, a wall (or walls) of the cavity (cavities) forms at least a part of the manifolding. In some such embodiments, the cavity (cavities) wall (or walls) includes openings (perforations, holes, slots, vents, etc.) to allow fluid to flow between the cavity (cavities) and the pumping system. In some embodiments, one or more wall openings are located toward the top of the cavity (cavities) to result in a generally vertical fluid path through the cavity (cavities) during operation of the inventive system. In other embodiments, the wall opening(s) are also located toward the lower half of the cavity (cavities) to result in an at least a partially horizontal fluid path through the cavity (cavities) during operation of the inventive system (i.e. the draw of the pumping system will alter a portion of the fluid path from vertical to horizontal, or from horizontal to vertical, depending upon the direction of operation of the pumping system). This aids in eliminating "dead zones" (areas of stagnant washing fluid) within the cavity. In a preferred embodiment, the density of the wall opening(s) located toward the lower half of the cavity (cavities) is lower than the density of the wall opening(s) located toward the upper half of the cavity (cavities), such that the fluid path through the cavity (cavities) is substantially vertical. It will be appreciated that the density and/or pattern of wall opening(s) in the wall(s) of the cavity (cavities) may be varied considerably depending upon the desired and/or optimal fluid flow path through the cavity (cavities) and without departing from the spirit and scope of the instant invention.

In other preferred embodiments, the intake/discharge opening(s) in the cavity (cavities), the structure of the cavity (cavities), and/or the structure of the pumping system, are configured to provide a generally even flow of fluid across substantially an entire cross section of the cavity (cavities), where fluid is present, and preferably through generally the entire volume, of the cavity (cavities). In one such embodiment, the cavity (cavities) includes tubes, vanes or baffles extending toward, into or through the opening(s) from the cavity (cavities) toward the pumping system intake (when the pumping system is pulling fluid through the cavity) or discharge (when the pumping system is pushing fluid through the cavity) to help direct the flow of fluid from and/or into the cavity (cavities). In one embodiment, the tubes, vanes or baffles are part of an intake/discharge plate that is located at the pumping system intake location of the cavity (cavities) when the pumping system is pulling fluid through the cavity (cavities), or at the pumping system discharge location when the pumping system is pushing fluid through the cavity (cavities), between the intake/discharge (when pulling/pushing respectively) opening(s) and the pumping system. In another embodiment, the intake/discharge opening(s) of the cavity (cavities) and the diameter of the intake/discharge of the pumping system generally spans across the entire end of the cavity (cavities) to create the generally even flow of fluid through the cavity.

The foregoing and other objects are intended to be illustrative of the present general inventive concept and are not meant in a limiting sense. Many possible embodiments of the present general inventive concept may be made and will be readily evident upon a study of the following specification and accompanying drawings comprising a part thereof. Various features and subcombinations of present general inventive concept may be employed without reference to other features and subcombinations. Other objects and advantages of this present general inventive concept will become apparent from the following description taken in connection with the accompanying drawings, wherein is set forth by way of illustration and example, an embodiment of this present general inventive concept and various features thereof.

BRIEF DESCRIPTION OF THE DRAWINGS

A preferred embodiment of the present general inventive concept, illustrative of the best mode in which the applicant has contemplated applying the principles, is set forth in the following description and is shown in the drawings.

FIG. 9 is a top perspective view of a silverware/flatware washing system of yet another embodiment of the present general inventive concept.

FIG. 11 is a front elevation sectional view of the silverware/flatware washing system of FIG. 10 taken along line A-A.

FIG. 12 is a detailed view of area B shown in FIG. 11.

DETAILED DESCRIPTION OF THE PREFERRED EMBODIMENTS

Figure 1:
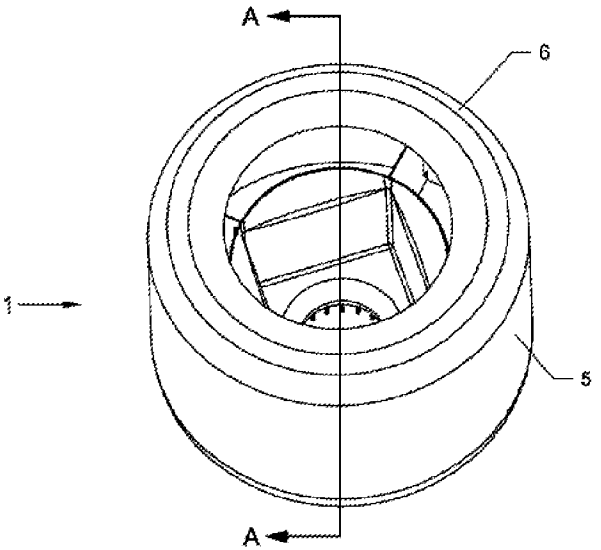
FIG. 1 is a top perspective view of a silverware/flatware washing system of an embodiment of the present general inventive concept.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1-5, a first embodiment of the present general inventive concept features a silverware/flatware washing system 1 having a generally cylindrical housing 5 with inwardly curved upper and lower portions 6 and 7 that act as a manifolding to respectively direct a flow of fluid to and from an impeller 9 and through a cavity 10 for holding silverware/flatware or other items. Although impeller 9 shown in the embodiment of FIGS. 1-5 is a centrifugal-type impeller, it will be appreciated that a centrifugal-type pumping system, a propeller-type pumping system, or any other type of pumping system now known or hereafter developed that is suitable for moving a large volume of fluid may be utilized in any of the embodiments disclosed herein without departing from the spirit and scope of the instant invention.

The housing 5 is filled with fluid (water, a water/detergent mixture, or other suitable fluid), preferably to a level near or above the top of the silverware cavity 10. Upon activation of motor 60 which drives the impeller 9, a vacuum is created that pulls fluid into impeller 9. A stream of fluid is then ejected, pushed, or otherwise diverted from the impeller 9 in a lateral direction and to the lower portion 7. The wall of lower portion 7 changes/redirects the direction of the fluid ninety degrees (90°) toward an upward direction as the fluid flows along an interior, generally straight wall 8 of the housing 5. The straight wall 8 connects to the upper portion 6 of the housing 5. As the fluid reaches the upper portion 6, the direction of the stream of fluid is redirected by the upper portion 6 of the housing and/or by gravity toward the center of the housing 5 and downward through silverware cavity 10. In the embodiment shown in FIGS. 1-5, the path of the stream of fluid is redirected by upper portion 6 of housing 5 at an angle of approximately 120°. Nevertheless, it will be appreciated that the angles at which the stream of fluid may be redirected at any particular point within housing 5 (e.g. by lower portion 7, by upper portion 6, or by additional manifolding structures anywhere therebetween or otherwise within housing 5 and/or by gravity) may vary considerably without departing from the spirit and scope of the instant invention and that alternative manifold structures will be apparent to those of ordinary skill in the art.

Figure 2:
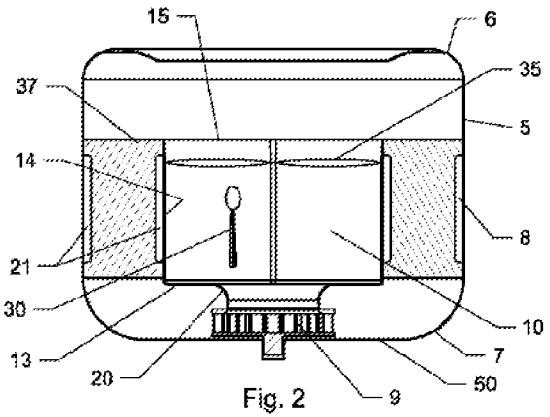
FIG. 2 is a front elevation sectional view of the silverware/flatware washing system of FIG. 1 taken along line A-A.
Figure 3:
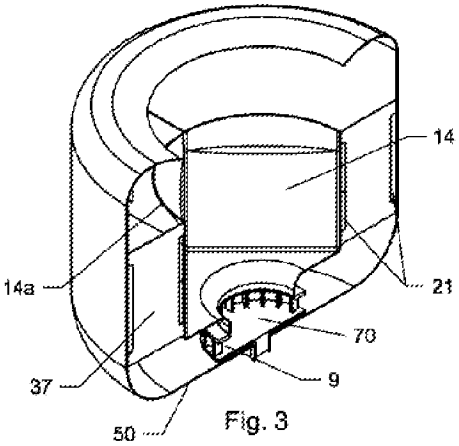
FIG. 3 is a side perspective sectional view of the silverware/flatware washing system of FIG. 1 taken along line A-A.
Figure 4:
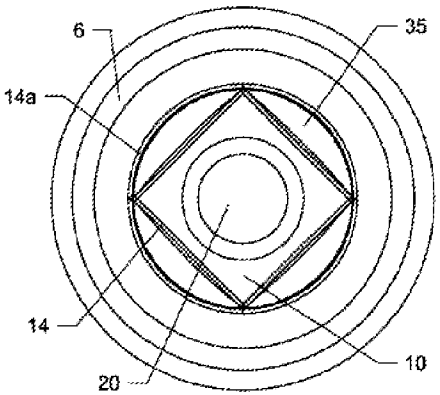
FIG. 4 is a top plan view of the silverware/flatware washing system of FIG. 1.

The downwardly-directed fluid enters the silverware/flatware cavity 10, which in a preferred embodiment includes one or more silverware/flatware support racks 12 (shown in FIG. 5) for supporting silverware/flatware 30. As shown in FIG. 2, the silverware/flatware cavity 10 includes a bottom surface 13, side surfaces 14, and an open top 15. The open top results in little to no back pressure, except for gravity which assists in directing the flow of fluid into cavity 10. Bottom surface 13 includes opening 20 to provide an intake port between silverware/flatware cavity 10 and interior 70 of impeller 9. In a preferred embodiment, a perforated screen is located over opening 20 to prevent items from being pulled into impeller 9 during operation. It will be appreciated that alternative structures for opening 20 and bottom surface 13 may be utilized without departing from the spirit and scope of the instant invention. For example, in one alternative embodiment, opening 20 comprises multiple small apertures/perforations through surface 13, such that surface 13 itself acts as a screen to prevent items from being pulled into impeller 9 while at the same time allowing fluid to be drawn into impeller 9 through the apertures. It will further be appreciated that the dimensions and shape of opening 20, as well as the size of impeller 9, may vary significantly in alternative embodiments depending upon the desired flow characteristics. In the embodiment shown in FIGS. 1-5, the diameter of the intake (opening 20) of cavity 10 is considerably smaller than the diameter of cavity 10 itself. Thus, it will be appreciated that various embodiments may include tubes, vanes or baffles extending toward, into or through opening 20 of cavity 10 and toward impeller 9 to help direct the flow of fluid from cavity 10 to impeller 9. In one embodiment, the tubes, vanes or baffles are part of a plate that is located at opening 20 (either partially or totally within cavity 10 or partially or totally within the manifolding, or partially within cavity 10 and partially within the manifolding). In another embodiment, the opening 20 generally extends across the entire area of bottom surface 13, such that a generally even flow is created through the entire volume of silverware/flatware cavity 10. In still another embodiment, the shape or other design elements of the manifolding help to direct the flow of fluid from cavity 10 to impeller 9. It will be appreciated, that although the flow control structures described above are discussed in connection with a system in which fluid is pulled from cavity 10 to impeller 9, the same or similar control structures may also be utilized in connection with systems in which fluid is pushed into the cavity from a propeller or other pumping method. Furthermore, it will be appreciated that the flow control structures, and other various components of the washer apparatuses discussed in any embodiment herein may be interchangeable with similar components in other embodiments discussed herein and/or in other non-discussed embodiments that will be apparent to those of ordinary skill in the art.

Figure 5:
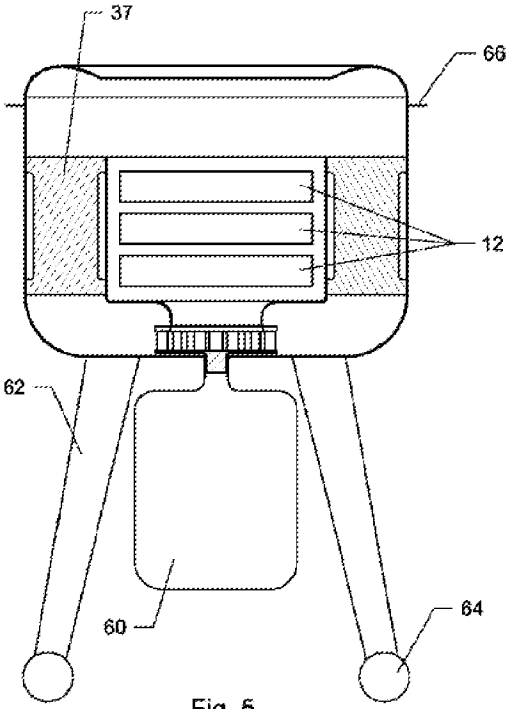
FIG. 5 is a front elevation sectional view of a silverware/flatware washing system of another embodiment of the present general inventive concept similar to that of FIG. 1.

In the embodiment shown in FIGS. 1-5, the side surfaces 14 are arranged together such that silverware/flatware cavity 10 is generally cube shaped (square in a horizontal cross-section as shown in FIG. 5). Such a shape allows for the use of conventional silverware/flatware support racks 12 within cavity 10. Nevertheless, it will be appreciated that the shape of cavity 10 used in connection with any of the embodiments discussed herein may be altered without departing from the spirit and scope of the instant invention. For example purposes only, the cross-sectional shape of cavity 10 in the embodiment shown in FIGS. 1-5 may be rectangular, circular, triangular, or any other shape desired rather than the square shape shown. In the embodiment shown in FIGS. 1-5, the upper edges 35 of side surfaces 14 are beveled upward and outward toward a separate internal side wall **14*a* of housing 5. The internal side wall 14*a* creates a generally cylindrical manifolding cavity with wall 8. The generally cylindrical shape of the manifolding cavity allows for a generally laminar flow of fluid from impeller 9 and into silverware/flatware cavity 10. Notwithstanding, it will be appreciated that alternative shapes may be utilized without departing from the spirit and scope of the instant invention. Moreover, it will be appreciated that internal side wall 14*a*** may be eliminated entirely without departing from the spirit and scope of the instant invention.

Silverware/flatware cavity 10 is supported within housing 5 by web sections 37 which span from wall 8 of housing 5 to wall 14 of the silverware/flatware cavity 10. In the embodiment shown in FIGS. 1-5, four web sections 37 are utilized to connect wall 8 of housing 5 to each of the four corners of the generally cube-shaped silverware/flatware cavity 10. Web sections 37 include openings 21 to allow fluid to flow freely within the entire volume of the manifolding created by cavity 10 and housing 5. It will be appreciated that alternative structures and arrangements of web sections 37 may be utilized without departing from the spirit and scope of the instant invention. For example purposes only, an alternative embodiment may utilize two (2) web sections rather than four, and the size and shape of openings 21 may be altered significantly from that shown in FIGS. 1-5.

The support rack 12 may be a single rack, or a plurality of racks, of which one, some, or all may or may not be removable from the silverware/flatware cavity 10. In a preferred embodiment all support rack(s) are removable from cavity 10. In a preferred embodiment, the support rack 12 includes one or more internal walls bridging the side surface 14 of silverware cavity 10, sized and shaped to maintain a desired orientation of the silverware/flatware 30. For instance, the silverware/flatware 30 may be positioned standing up, laying down, angled, and/or stacked or piled on top of each other depending upon the structural design of the support rack and/or cavity 10. In the embodiment shown in FIG. 5, multiple support racks 12 are stacked or stackable on top of one another. In an alternative embodiment, multiple support racks (compartments, or cavities) are oriented along side each other (i.e. side by side instead of on top of one another).

The impeller 9 both pulls fluid from opening 20 of cavity 10 and discharges fluid into open top 15 of silverware/flatware cavity 10, creating a generally even flow of fluid through the entire volume of the silverware/flatware cavity 10. This generally high volume of fluid forces the fluid to flow through silverware/flatware cavity 10 more fully such that the flow of fluid more closely surrounds the entire surface of each piece of flatware/silverware 30 within the silverware/flatware cavity 10. The flow of fluid through cavity 10, essentially has no alternative path but to travel through generally the entire mass of silverware/flatware within cavity 10. Thus, the deflections of conventional systems described above are greatly reduced.

In a preferred embodiment, the housing 5 may be disassembled for easy cleaning. In one embodiment, the housing may be disassembled into three sections, i.e., the upper portion 6 may be removed at the internal straight wall 8, which can also be removed at the lower portion 7. The upper portion 6, internal straight wall 8, and lower portion 7 may be securely coupled using latches (not illustrated), screwed together with corresponding inner and outer threaded surface, or other like engagement means.

In a preferred embodiment, fluid (i.e. water and/or soap, etc.) is automatically and/or manually input into and/or output from the system. In one embodiment, water (and/or soap/detergent) is input into silverware/flatware cavity 10 through the generally open central portion of the top surface of housing 5. In another embodiment, a drain (not shown) is located along bottom surface 50, to allow fluid (water, soap, etc.) to be quickly and easily removed from the system. Once the system 1 is filled with fluid (water and/or detergent, etc.), the system 1 is self-sustaining such that fluid need not be added for a certain amount of time, e.g., until the fluid is sufficiently contaminated with debris. In a preferred embodiment, system 1 is filled to a level of fluid above the top of upper beveled edges 35 such that the fluid fills the silverware/flatware cavity as well as the manifolding created by the housing 5. In one preferred embodiment, an overflow drain is included above the preferred fluid level to prevent overflow of system 1 caused for example by increased volume due to soap foam or the like.

In one embodiment, the system 1 of the instant invention is a stand-alone unit that may be located in any convenient location in kitchen or restaurant. As is shown in FIG. 5, such an embodiment includes legs 62 extending from housing 5 and wheels 64 to allow the unit to be easily moved. In another embodiment, the system 1 of the instant invention may be mounted within (or dropped into) a countertop or table. In one such embodiment, housing 5 includes annular lip 66 that allows system 1 to be dropped into a cutout in the countertop/table in the same or similar manner in which a sink/basin would be installed.

Figure 6:
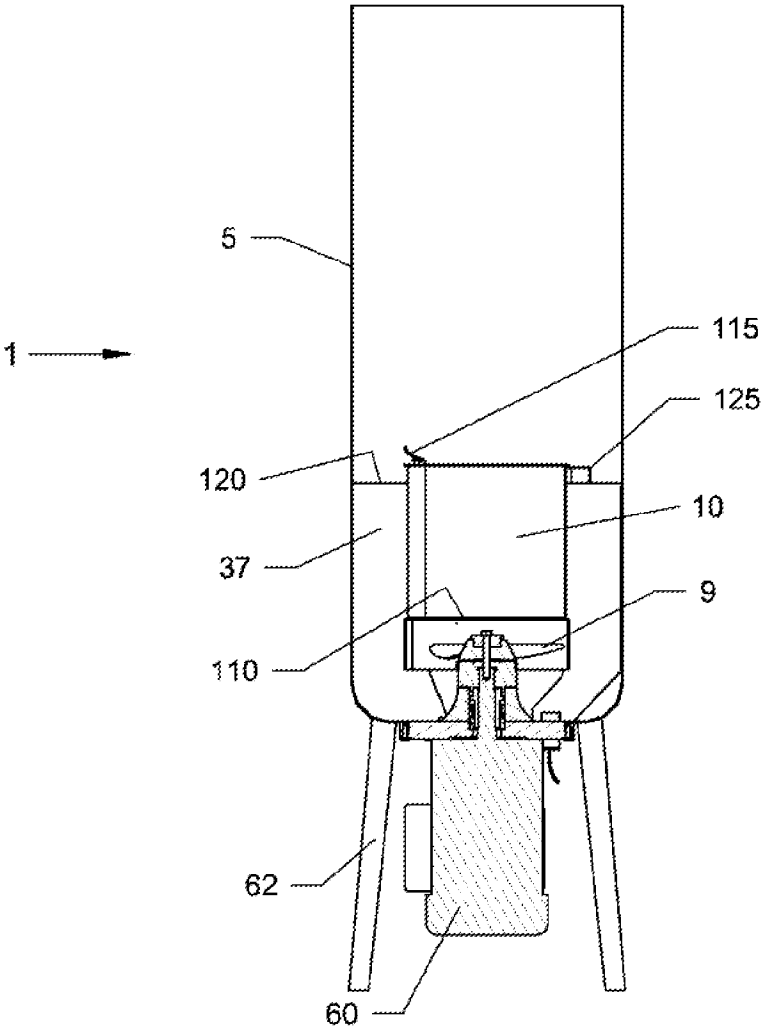
FIG. 6 is a front elevation sectional view of a silverware/flatware washing system of still another embodiment of the present general inventive concept.
Figure 7:
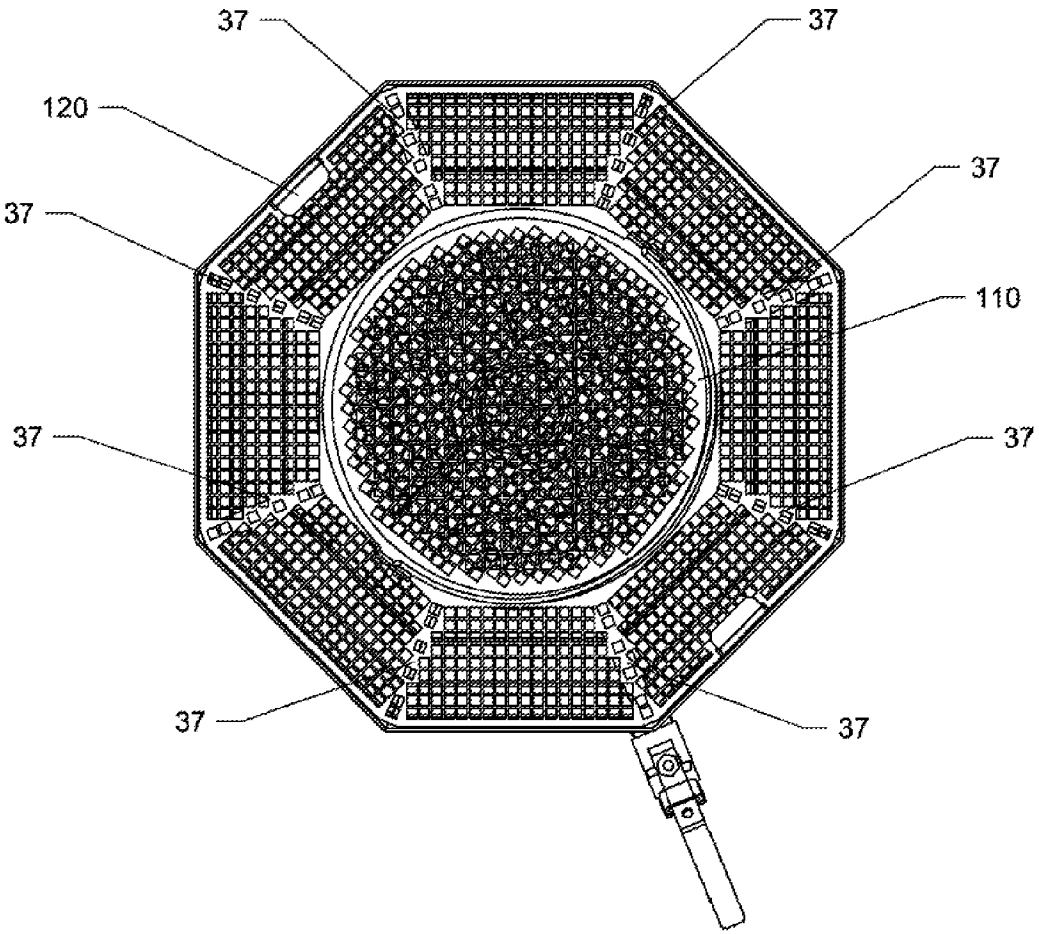
FIG. 7 is a top plan view of the silverware/flatware washing system of FIG. 6.
Figure 8:
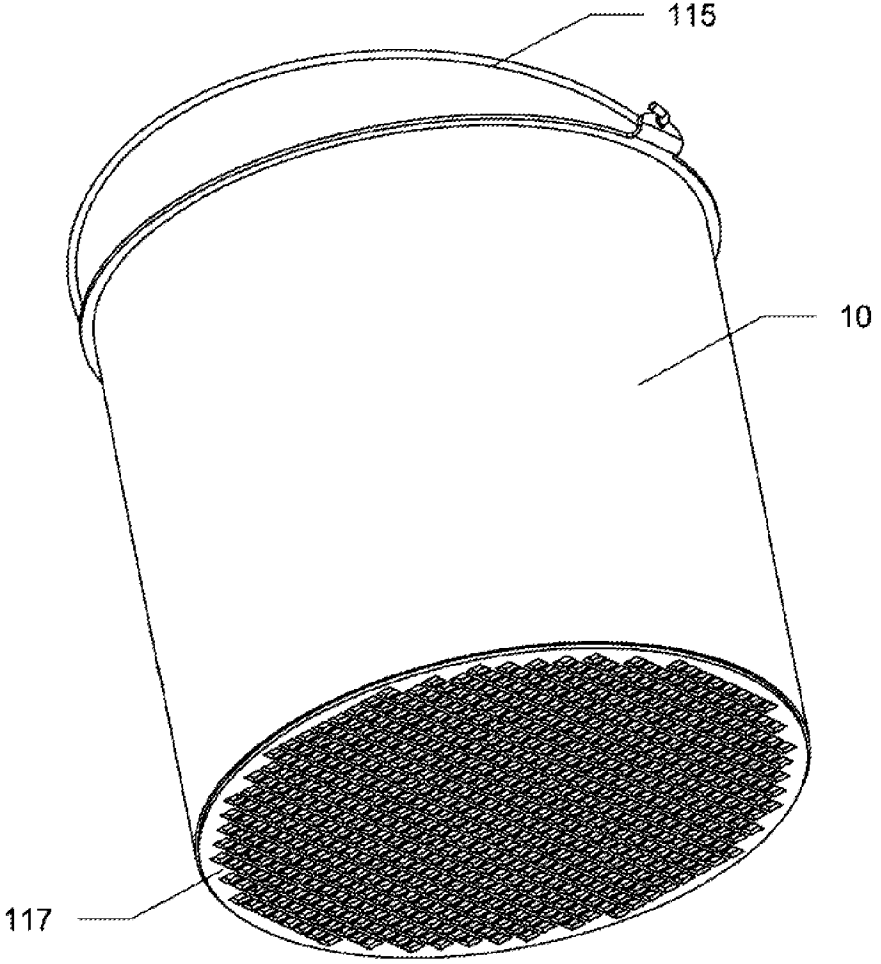
FIG. 8 is a bottom perspective view of a removable silverware cavity of the silverware/flatware washing system of FIG. 6.

Referring to FIGS. 6 through 8 another embodiment of a silverware/flatware washing system 1 is shown and described in which cavity 10 is removably located within housing 5. Cavity 10 is a bucket-type container that includes handle 115 for removing cavity 10 from housing 5, and includes generally perforated bottom 117 to allow fluid to flow into and/or out of the bottom of cavity 10 while at the same time maintaining silverware/flatware within cavity 10. Web sections 37 extend from the inner surfaces of housing 5 toward its center. Web sections 37 are connected to perforated intake member 110 which covers propeller 9, and to perforated upper support member 120. Intake member 110 acts as a shelf on which cavity 10 is positioned during operation of system 1. Upper support member 120 provides support for web sections 37 and also acts as a guide for positioning cavity 10 properly within housing 5. The perforated surface of upper support member 120 allows fluid to flow through as system 1 operates. Upper support member 120 includes grip member 125 for easy removal of support member 120 for cleaning.

Housing 5 shown in FIGS. 6 through 8 is generally octagonal in shape for ease of manufacturing. Nevertheless, it will be appreciated that any shape of housing may be utilized in this embodiment (or in any other embodiment) without departing from the spirit and scope of the instant invention. Furthermore, it will be appreciated that alternative housing and component structures, such as double-skinned or insulated walls, may be utilized without departing from the spirit and scope of the instant invention.

In operation, cavity 10 is filled with silverware/flatware and is positioned within housing 5 onto intake member 110. In the embodiment shown, numerous pieces of silverware/flatware are randomly pilled on top of one another into a mass within cavity 10. Nevertheless, it will be appreciated, that support racks similar to those discussed above with respect to the embodiment shown in FIGS. 1-5 may also be utilized. Cavity 10 and/or housing 5 is filled with fluid (note that housing 5 may be filed while cavity 10 is removed, or while cavity 10 is located within housing 5) to a level preferably above the mass of silverware/flatware (i.e. the mass of silverware is completely submerged) and that is preferably above upper support member 120. Motor 60 is activated to drive propeller 9 to cause the flow of fluid through cavity 10. Preferably, the direction of motor 60 is capable of being reversed to alternately drive propeller 9 in either a forward or reverse direction. In one of the forward or reverse directions, propeller 9 will create a suction that pulls fluid downward through intake member 110. In the other of the forward or reverse directions, propeller 9 will push water upward through intake member 110 (making intake member 110 actually a discharge). Regardless of the flow direction, housing 5 and the outer wall of cavity 10 act as a manifolding to circulate fluid that is drawn by propeller 9. Referring to FIG. 6 and FIG. 7, the diameter of propeller 9 and intake member 110 are equal to the diameter of, or generally span across the entire perforated bottom 117 of cavity 10. This creates a generally even flow of fluid through the entire volume of cavity 10. It will be appreciated that to create a flow of fluid through the entire volume of cavity 10, particularly when cavity 10 is full of a mass of silverware/flatware, the pumping system must be powerful enough to create a column of fluid that can blast through the entire flood plane created within filled cavity 10. The specific design parameters needed to enable the pumping system (including, but not necessarily limited to the size of motor 60 and the size, shape, etc. of propeller 9) to create a desired flow of fluid through the entire volume of cavity 10, and through the mass of silverware/flatware loaded within cavity 10, will vary depending upon factors such as the size and shape of cavity 10, as well as desired load capability for cavity 10, and will be readily apparent to a person of ordinary skill in the art.

Figure 13:
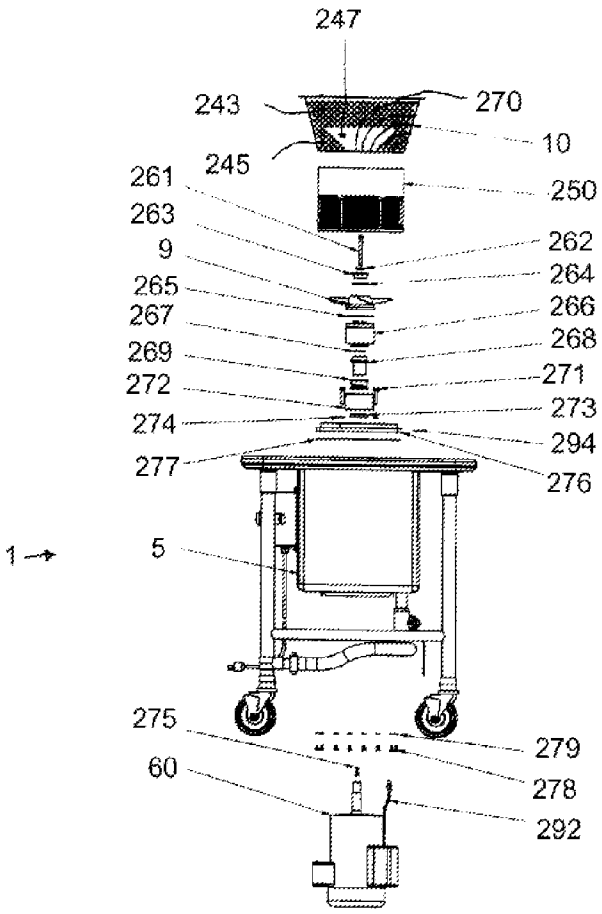
FIG. 13 is an front elevation exploded view of another embodiment of a silverware/flatware washing system of the present general inventive concept similar to that of FIG. 9.

Referring to FIGS. 9 through 13 two similar variations of other embodiments of a silverware/flatware washing system is shown. The silverware/flatware washing system of FIGS. 9 through 12 is particularly well-suited for pulling cleaning fluid (water/detergent, etc.) downward through cavity 10 from/by propeller 9, while the system of FIG. 13 is particularly well-suited for pushing cleaning fluid upward through cavity 10. Nevertheless, it will be appreciated that the structure of FIGS. 9 through 12 may also be utilized in connection with a system in which fluid is pushed upward through cavity 10, and/or in connection with a system in which the direction of fluid flow is oscillated between forward and reverse directions (i.e. 10 minutes forward, then 10 minutes reverse, etc.) during a wash cycle to both push and pull fluid through cavity 10 by propeller 9. Likewise, it will be appreciated that the structure of FIG. 13 may also be utilized in connection with a system in which fluid is pulled downward through cavity 10, and/or in connection with a system in which the direction of fluid flow is oscillated between forward and reverse directions (i.e. 10 minutes forward, then 10 minutes reverse, etc.) during a wash cycle to both push and pull fluid through cavity 10 by propeller 9. It will also be appreciated that although the structures of the embodiments described in connection with FIGS. 1 through 8 are particularly well-suited for pulling fluid downward through cavity 10 by impeller/propeller 9, those structures may be utilized in connection with a system in which fluid is pushed upward through cavity 10, and/or in connection with a system in which the direction of fluid is oscillated between forward and reverse directions to both push and pull fluid through cavity 10.

As is shown in FIGS. 9 through 13, cavity 10 is removably positioned within housing 5 of washing system 1. Cavity 10, includes handles 215 for easy removal and reinsertion of cavity 10 within housing 5. This allows cavity 10 to be loaded with silverware/flatware prior to insertion into housing 5 of washing system 1. Cavity 10 includes perforations 243 and 245 located toward the upper and lower portions of the walls of cavity 10 respectively (discussed in further detail below). This creates two wash actions, in a situation in which the system is operating in an upward direction (i.e. pushing fluid upward through cavity 10 from propeller 9): 1) a first action is to push fluid up through the silverware/flatware, as the fluid approaches the top of cavity 10 gravity reduces the upward velocity of the fluid and ultimately causes the fluid path to change from an upward to a downward direction and then the fluid ultimately is pulled through the perforations (243) located toward the top of cavity 10 to return to propeller 9 through the manifolding that is created by housing 5 and cavity 10; and 2) the second action is to pull fluid horizontally toward the side of cavity 10 through the perforations (245) located toward the lower end of cavity 10 (i.e. the velocity and/or direction of the flow of fluid is altered from generally vertical as it is discharged from the propeller 9, to generally horizontal), then through the manifolding to return to propeller 9. Similarly, in a situation in which the system is operating in a downward direction (i.e. by pulling fluid downward through cavity 10 by propeller 9): 1) a first action is to pull fluid downward through cavity 10 and through the silverware/flatware, the fluid is then directed back upward through the manifolding and toward the top of cavity 10; and 2) the second action is to pull fluid horizontally from the manifolding toward the center of cavity 10 through the perforations (245). The second, horizontal action helps to eliminate or minimize any "dead zones" within cavity 10, resulting generally in a flow of fluid through the entire volume of cavity 10.

Figure 10:
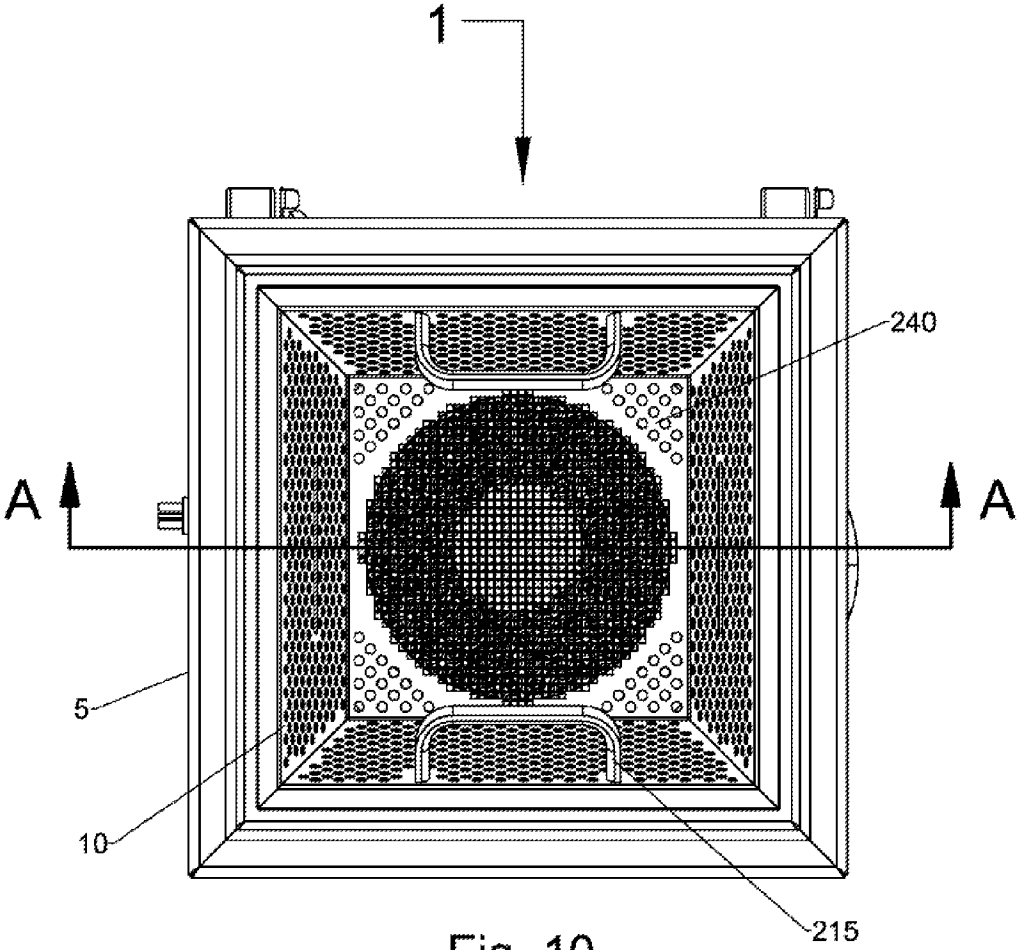
FIG. 10 is a top plan view of the silverware/flatware washing system of FIG. 9.

As is shown in more detail in FIG. 10, cavity 10 includes a generally square or rectangular bottom. The square/rectangular bottom works well for loading a mass of silverware/flatware into cavity 10, due to the generally long and narrow shapes and sizes of those items. This shape allows generally the entire volume of cavity 10 to be filled with silverware/flatware laying down flat in cavity 10. Alternatively, if a rounded shape is used, similar to that shown in FIGS. 6 through 8, the silverware/flatware will tend to create a chord across the circular shape, and less items will be located outside the chord region than toward the center of the circle. Although the bottom of cavity 10 is square/rectangular, the opening at the bottom of cavity 10 is round in shape to mate with the shape of the rotational path of propeller 9, which pulls (or pushes) a generally circular column of fluid upward through cavity 10. This creates potential dead zones 240 at the corners of cavity 10, in which little or no vertical fluid flow will take place. As shown in FIG. 10, in the embodiment of FIGS. 9 through 12 perforations are located along the bottom corners of cavity 10 to push or draw fluid through the dead zones 240 in a generally vertical manner. The vertical draw is created by the draw force of propeller 9 of the pumping system when the system is operating in an upward manner (i.e. fluid is being pushed upward through cavity 10 by propeller 9). The vertical pushing force is created by the discharge of propeller 9 as it is directed upward by the manifolding of housing 5 when the system is operating in a downward manner (i.e. the fluid is being pulled downward through cavity 10 by propeller 9). Also, in both the embodiment shown in FIGS. 9 through 12 and that shown in FIG. 13, perforations 245 are included at the lower corners of cavity 10 to draw fluid through the dead zones 240 in a generally horizontal manner. This horizontal draw is created by the draw force of propeller 9 of the pumping system when the system is operating in both an upward and a downward manner.

As is shown in FIG. 13, perforations 243 are located generally evenly throughout the entire upper portion of the walls of cavity 10; while the lower portion of the walls includes perforations 245 only at the corners of cavity 10 and otherwise includes solid wall portions 247 away from the corners. As is shown by flow lines 270 in FIG. 13, this design allows for some horizontal linear flow through cavity 10 at the corners of cavity 10, while at the same time allowing for generally vertical linear flow through the majority of the volume of cavity 10. It will be appreciated that the perforation pattern of cavity 10 may be modified to optimize the desired flow path of fluid through cavity 10.

As is shown in both embodiments of FIGS. 11 and 13, cavity 10 has a generally tapered shape from top to bottom in which the top is generally wider in diameter than the bottom of cavity 10. The top of cavity 10 further includes an annular lip that surrounds housing 5 such that when cavity 10 is placed within housing 5 and the lip holds cavity 10 securely within housing 5. Cavity 10 is further supported within housing by shroud subassembly 250, on which the bottom of cavity 10 is placed and rests when cavity 10 is located within housing 5. The tapered shape of cavity 10, compared to the generally vertical walls of housing 5 create an open space or manifolding between the walls of cavity 10 and housing 5.

Referring to FIG. 13, an exploded view of the components to system 1 is shown. It will be appreciated that although similar components may be used in both the embodiment shown in FIGS. 9 through 12 and that shown in FIG. 13, various differences in individual components may be desirable, particularly due to the fact that the embodiment of FIGS. 9-12 is particularly well-suited for pulling cleaning fluid (water/detergent, etc.) downward through cavity 10 from/by propeller 9, while the system of FIG. 13 is particularly well-suited for pushing cleaning fluid upward through cavity 10. For example, the orientation of propeller 9 is upside down in FIGS. 9-12 when compared to that of FIG. 13 to provide better flow in the preferred pulling direction. As a result, the size, shape and structural design of various components such as the impeller cap, seals and shaft extension all differ to accommodate the different orientation of propeller 9. Furthermore, the embodiment of FIGS. 9-12 includes a number of vertical panels arranged in a radial pattern directly below propeller 9 to assist the flow of fluid as it is discharged from propeller 9. The vertical panels aid in converting rotational energy from the propeller into a more linear flow of the fluid. Nevertheless, it will be appreciated that various other structures for assisting the flow of fluid through the system of the instant invention will be apparent to those of ordinary skill in the art upon learning of the instant inventive concept.

As is shown in FIG. 13, cavity 10, fits within housing 5 with the annular lip of cavity 10 surrounding the outer edge of the opening of housing 5 to support cavity 10 in position within housing 5. Cavity 10 further is supported in position within housing 5 by sitting on top of shroud subassembly 250, which surrounds propeller 9. Shroud subassembly 250 aids in restricting the flow path generated by propeller 9 through a generally solid-walled section that surrounds propeller. Fluid either enters (in a system in which propeller 9 pushes fluid upward into cavity 10) or is discharged from (in a system in which propeller 9 pulls fluid downward through cavity 10) shroud subassembly 250 through slots, holes or other openings located in shroud subassembly 250 generally below propeller 9. Propeller 9 is mounted to the shaft of motor 60 using cap screw 261, self sealing washers 262, impeller cap 263 and cap seal 264. The assembly for mounting propeller 9 to the shaft of motor 60 further includes quad ring 265, shaft extension 266, o-ring 267, pump shaft sleeve 268, rotating seal 269, cap screw 271, seal housing 272, fixed seal 273, quad ring 274, and cap screw 275. Motor 60 is mounted below housing 5 with the shaft extending into housing 5. Motor 60 is mounted to housing 5 using motor plate 276 and motor plate gasket 277 within housing 5; cap screw 275 and cap screws/hex bolts 278 and lock washers 279 are located below housing 5 to hold motor plate 276 in position. Pin 294 is located within a fluid drainage passageway into motor plate 276. Pin 294 closes off a horizontal portion of the passageway to direct fluid only through a vertical portion of passageway and out through tubing 292. This allows for drainage of any fluid that may push through the seals. Referring to FIG. 12, the mounting assembly of motor 60 (which is essentially the same for both the embodiment shown in FIGS. 9 through 11 and the embodiment shown in FIG. 13) is shown in further detail. As is shown in FIG. 12, motor 60 is mounted to housing 5 through the use of hex bolts 278 which extend through helical spring lock washers 279 below housing 5, through the bottom of housing 5, further through motor plate gasket 277 and into motor plate 276 located within housing 5. Housing 5 is supported by a leg assembly and caster wheels which allow system 1 to be a self-standing unit. A drain is located at the bottom of housing 5 to allow fluid to be drained from system 1. The drain is connected to drain tubing that includes a ball valve (or other suitable valve) for opening and closing the drain as desired.

In operation, cavity 10 of either the embodiment shown in FIGS. 9 through 12 or that of FIG. 13 is filled with silverware/flatware and placed within housing 5 which is filled with wash fluid. The level of wash fluid is preferably above the level of the mass of silverware/flatware located within the cavity. When either system is operated to push fluid up through cavity 10 by propeller 9, as fluid is pumped up from propeller 9 and into cavity 10, the upward force will push upward into the silverware/flatware or other objects/parts located within cavity 10. This will tend to cause the objects/parts to "float" and move slightly upward, around and/or apart from one another, thereby reducing nesting and increasing cleaning efficiency.

As is discussed above, to create the flow of fluid through the entire volume of cavity 10, particularly when cavity 10 is full of a mass of silverware/flatware, the pumping system must be powerful enough to create a column of fluid that can blast through the entire flood plane created within filled cavity 10. In the embodiments shown in FIGS. 9 through 13, a pumping system capable of pumping roughly 9000 gallons of fluid per minute is utilized to create approximately a ten inch diameter by 10 inch high column of moving fluid within cavity 10. Nevertheless, it will be appreciated that either higher or lower capacity pumping systems may be utilized, depending upon the desired cleaning action, flow characteristics, load capacity, and other design considerations.

During operation of the pumping system, the entire volume of cavity 10 is continuously exchanging fluid as fluid flows through the pumping system and back through cavity 10. The column of fluid or flow of fluid through cavity 10 includes a cross section area that is at least equal to, and preferably greater than the cross-section area of the items being washed within cavity 10. Thus, the entire area of the items are exposed to the flow of fluid through cavity 10.

In a preferred embodiment of the instant invention, the primary components of system 1 described herein are all manufactured of stainless steel for durability and to prevent rusting. Nevertheless, it will be appreciated that any suitable materials for the various components may be utilized without departing from the spirit and scope of the instant invention.

Although shown and described herein as a single cavity, it will be appreciated that cavity 10 of the instant invention can actually consist of multiple individual cavities or compartments within a single housing. Such cavities or compartments may be arranged horizontally (i.e. stacked on top of one another) or vertically (i.e. located side by side of one another), or in any other arrangement desired. It will be appreciated that the singular term "cavity" as used herein and particularly as used in the appended claims, is intended to refer to one or more cavities or compartments. Furthermore, it will be appreciated that other singular terms (including, but not limited to "opening", "port", "perforation", "side", "wall", "intake", "discharge", "mass", "rack") as used herein, and particular as used in the appended claims, are intended to refer to one of more of such components.

In a preferred embodiment, motor 60 is a 110 volt motor providing increased flexibility over larger motors. It will be appreciated that other components, such as a water heater, may be included in system 1 without departing from the spirit and scope of the instant invention. Nevertheless, for energy efficiency purposes, one preferred embodiment of system 1 specifically excludes a water heater, such that the only energy requirement comes from motor 60. In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to exemplary embodiments suitable for washing (or pre-washing) silverware/flatware, it will be appreciated that the described embodiment, or other alternative embodiments of the present invention may be utilized for cleaning other objects/parts besides or in addition to silverware/flatware. By way of non-limiting example, the present invention may be utilized as a "clean out of place" machine for cleaning one or more objects/parts that are removed from other machines (i.e. cleaning parts of milk shake machines, ovens, and other machines) and placed in a parts cleaner of the instant invention. In one preferred embodiment, system 1 described above may be utilized as a "clean out of place" machine for one or more larger parts by removing any support racks that may be located in cavity 10. In still another non-limiting example, the present invention may be utilized to clean automotive parts. In one such preferred embodiment, system 1 will include a lid over the top of cavity 10 to prevent the harsher cleaning solvent/fluid from splashing out and possibly injuring an operator. In another such preferred embodiment, a safety switch is operatively connected with the lid to prevent operation when the lid is open. This helps to prevent user exposure to more caustic cleaning fluids that may be associated with such applications. Nevertheless, it will be appreciated that such structural components may be utilized in connection with less caustic applications as well, if desired. In addition, it will be appreciated that the instant invention may be utilized as a pre-cleaning system, in which silverware/flatware is cleaned to remove soil, and then run through one or more additional wash, rinse or sanitizing systems/processes. As such, as used herein, the term "washing" is intended to include any cleaning, washing, pre-washing, pre-cleaning, rinsing, sanitizing, disinfecting, sterilizing or other similar debris, germ or other foreign matter removal processes or activities.

Although the foregoing detailed description of the present invention has been described by reference to exemplary embodiments, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein (including, but not limited to any and all combinations of one or more components from one embodiment disclosed herein with one or more components from another embodiment disclosed herein or from other embodiments hereinafter developed). Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A fluid circulating system for washing items, the system comprising:

a housing defining a cavity for locating silverware, flatware or one or more other items during operation; and a pumping system including a manifolding in fluid communication with said cavity of said housing, wherein said manifolding defines a fluid pathway extending between first and second locations associated with said cavity of said housing, said first location being displaced from said second location, wherein said pumping system oscillates from a forward direction to a reverse direction during operation, wherein said pumping system draws fluid from said cavity at said first location and directs the fluid to the second location when the pumping system is operating in the forward direction, thereby causing generally a continuous flow of fluid across substantially an entire cross section of said cavity moving through the items towards the first location, and wherein said pumping system draws fluid from said cavity at said second location and directs the fluid to the first location when the pumping system is operating in the reverse direction, thereby causing generally a continuous flow of fluid across substantially an entire cross section of said cavity moving from the items towards the second location.

2. The fluid circulating system as claimed in claim 1 wherein said manifolding is associated with an opening, and said opening generally extends across an entire area of an end of said cavity.

3. The fluid circulating system as claimed in claim 2 wherein said opening comprises a flow control structure.

4. The fluid circulating system as claimed in claim 1 further comprising a flow control structure.

5. The fluid circulating system as claimed in claim 4 wherein said flow control structure comprises a port through said cavity.

6. The fluid circulating system as claimed in claim 4 wherein said flow control structure is located at least partially within said cavity.

7. The fluid circulating system as claimed in claim 4 wherein said flow control structure is located at least partially within said manifolding.

8. The fluid circulating system as claimed in claim 4 wherein said manifolding acts as said flow control structure.

* * * * *